US009644910B2

(12) United States Patent
Kim

(10) Patent No.: US 9,644,910 B2
(45) Date of Patent: May 9, 2017

(54) APPARATUS FOR STORING AND LOADING MULTIPLE ROWS OF AMMUNITION

(71) Applicant: Raymond Kyungjune Kim, Federal Way, WA (US)

(72) Inventor: Raymond Kyungjune Kim, Federal Way, WA (US)

( * ) Notice: Subject to any disclaimer, the term of this patent is extended or adjusted under 35 U.S.C. 154(b) by 0 days.

(21) Appl. No.: 14/816,020

(22) Filed: Aug. 2, 2015

(65) Prior Publication Data

US 2017/0030669 A1 Feb. 2, 2017

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/84
USPC ..... 42/87, 88; 89/33.5, 34, 33.1, 33.17
See application file for complete search history.

(56) References Cited

U.S. PATENT DOCUMENTS 1,786,537 A * 12/1930 Holek ..... F41A 9/83 42/87
4,706,402 A * 11/1987 Csongor ..... F41A 9/84 42/87
4,739,572 A * 4/1988 Brandenburg ..... F41A 9/83 42/87
4,862,621 A * 9/1989 Kearney ..... F41A 9/83 42/87
5,107,751 A * 4/1992 Grabner ..... F41A 9/375 89/34
2012/0255211 A1* 10/2012 Kim ..... F41A 9/66 42/49.01

FOREIGN PATENT DOCUMENTS

EP EU 205 661 * 12/1986

* cited by examiner

*Primary Examiner* — Stephen M Johnson
(74) *Attorney, Agent, or Firm* — Dascenzo Intellectual Property Law, P.C.; Ian D. Gates

(57) ABSTRACT

The invention provides an ammunition storage box that stores and loads multiple successive rows of ammunition cartridges into firearms magazines. The box includes an interior channel and multiple openings that lead into the channel. The channel is configured to host and dispense cartridges into a firearms magazine interfaced with the box via a proximal opening, which leads into the channel. The box also includes cartridge slots, recessed into the box and convergent with the channel, configured to host cartridges. The box also includes an obstruction block configured to selectively engage within the channel and obstruct cartridges hosted within the cartridge slots from moving into the channel. The box also includes a rod, configured to slideably engage within the channel and displace obstruction blocks or cartridges within the channel out from the channel. The rod is also configured to encapsulate the cartridge slots when expanded into the chamber.

24 Claims, 14 Drawing Sheets

APPARATUS FOR STORING AND LOADING MULTIPLE ROWS OF AMMUNITION

BACKGROUND OF THE INVENTION

1. Field of the Invention

The present invention relates to ammunition cartridge storing and loading tools for firearms magazines.

2. Description of the Prior Art

Many contemporary ammunition box designs that are configured to sterily store and also load ammunition cartridges into firearms magazines do not have the ability to store and load more than one row of cartridges. Designs that do allow for the storage and loading of multiple rows of cartridges often require a large number of moving components to facilitate the alignment and urging of successive rows of cartridges into a magazine. Unfortunately, history has revealed time and time again that apparatuses with a large number of moving parts often have reduced reliability in outdoor environments.

At the moment, there exists no prior art design of ammunition storage and loading apparatuses that can align successive rows of ammunition cartridges for urging into a magazine without the utilization of a large number of moving components.

SUMMARY OF THE INVENTION

In light of the limitations of existing ammunition storage and loading apparatuses, it is the object of the present invention to provide an apparatus that can store multiple rows of ammunition cartridges and successively align each row of stored cartridges for urging into a firearms magazine using a significantly reduced number of moving components.

According to an embodiment of the present invention, an apparatus for storing and loading multiple rows of ammunition cartridges comprises an elongated rectangular box having a proximal long end, a distal long end and an adjacent side that lies between the proximal and distal long ends. The rectangular box comprises a linear channel that runs within the rectangular box, initiating at the proximal long end and running to the distal long end. The proximal long end, distal long end and adjacent side comprise a cartridge dispensing opening, rod entry opening and cartridge entry opening, respectively, all of which lead into the linear channel.

The rectangular box comprises cartridge slots that are recessed into the rectangular box through topside openings on the adjacent side. These cartridge slots are convergent with the linear channel and are configured to receive and host ammunition cartridges via the topside openings. Each cartridge slot extends a partition wall, which segregates the extending cartridge slot from an adjacent cartridge slot. In one embodiment, each cartridge slot extends a partition wall from a portion of the cartridge slot that lies of farthest distance from the dispensing opening. In one embodiment, the cartridge slots are arranged in two independent single file rows whose lengths run parallel with that of the linear channel. In this same embodiment, these two independent rows of cartridge slots are tangent with the linear channel on two opposing sides of the linear channel. Also in this same embodiment, partition walls on both rows of cartridge slots are offset from linear alignment with one another. Cartridge slots are recessed into the rectangular box in such a manner as to leave a height of space between the bottom of the cartridge slot recesses and a linear channel interior wall that lies farthest from the adjacent side, defined as the channel floor. The cartridge slots comprise obstruction walls that are tangent with the linear channel and run from each cartridge slot's partition wall towards the dispensing opening until within a gap of distance from an adjacent cartridge slot's partition wall. In one embodiment, the size of this gap of distance is equal to the width of an ammunition cartridge. Each gap of distance defines a slot side opening, configured to facilitate the passage of cartridges from the cartridge slots into the linear channel.

According to an embodiment of the present invention, an apparatus for storing and loading multiple rows of ammunition cartridges comprises a channel obstruction block shaped in the form of an elongated rectangular block. The obstruction block is selectively engaged within the linear channel of the rectangular box, through either of the rectangular box openings, in order to obstruct cartridges hosted within the rectangular box cartridge slots from passing into the linear channel, via the slot side openings, as the apparatus of the present invention is loaded with cartridges for storage. The apparatus is loaded with ammunition cartridges via the positioning of cartridges into the cartridge slots through the cartridge slot topside openings.

According to an embodiment of the present invention, an apparatus for storing and loading multiple rows of ammunition cartridges comprises an urging rod. The urging rod is shaped as an elongated rectangular block and extends a planar shaped flat cover that is coupled to the elongated rectangular block in such a manner as to form a T shape. The urging rod is slideably engaged within the rectangular box linear channel, through the rod entry opening, in such a manner as to cause the flat cover to slideably engage with the rectangular box adjacent side.

The apparatus of the present invention is configured for the sterile storage of cartridges via urging of the urging rod into the linear channel, through the rod entry opening, towards the dispensing opening until the urging rod comes into tangency with the dispensing opening. This action causes the urging rod to displace the obstruction block from the linear channel through the dispensing opening while simultaneously causing the rod to obstruct successive slot side openings, preventing cartridges hosted within cartridge slots with obstructed slot side openings from moving into the linear channel. Simultaneously, as the urging rod moves toward tangency with the dispensing opening, the flat cover is slideably engaged with the adjacent side and moved along with the urging rod to successively encapsulate all of the topside openings leading into the cartridge slots.

The apparatus of the present invention is interfaced with a firearms magazine for the transfer of cartridges from the apparatus into a firearms magazine. In one embodiment, this is accomplished by coupling a feed opening of a firearms magazine with the apparatus dispensing opening in such a manner that the magazine feed opening is oriented, relative to the dispensing opening, to receive cartridges from the dispensing opening in the same angular orientation by which the firearms magazine properly feeds ammunition cartridges into a firearm. In a preferred embodiment, cartridges are stored within two independent rows of cartridge slots, and cartridges hosted within each row of cartridge slots are successively displaced into the linear channel by canting the apparatus and interfaced magazine in such a manner as to elevate one row of cartridge slots, which hosts the cartridges that are subject for displacement, over an opposing row of cartridge slots. Simultaneously, the apparatus and interfaced magazine are also oriented in such a manner as to cause the rod entry opening to elevate over the dispensing opening. The urging rod is then retracted from the linear channel, through the rod entry opening, causing cartridges hosted in the elevated row 110 to move through the slot side openings 120, by force of gravity, toward the opposing row 110 until obstructed from further directional movement by the obstruction walls of the opposing row 110 or cartridges hosted within the opposing row. Simultaneous to this point, the displaced cartridges are vectored into the height of space, within the linear channel, that lies between the bottom of the cartridge slots and the linear channel floor, by force of gravity. The displaced cartridges travel down into the height of space until obstructed from further movement by the channel floor. Simultaneously, the displaced cartridges are also vectored towards the dispensing opening, by force of gravity, until obstructed from further directional movement by the coupled magazine feed opening or cartridges stacked in succession leading into the magazine opening. Each successive row of cartridges displaced from the two independent rows of cartridge slots into the linear channel are urged into the interfaced firearms magazine via the urging of the urging rod towards the dispensing opening. This action causes the urging rod to shift cartridges, displaced into the linear channel, through the dispensing opening into the magazine feed opening coupled to the dispensing opening.

BRIEF DESCRIPTION OF DRAWINGS

The preferred embodiment of the present invention is described in detail below with reference to the following drawings.

DETAILED DESCRIPTION OF THE PREFERRED EMBODIMENT

Figure 1A:
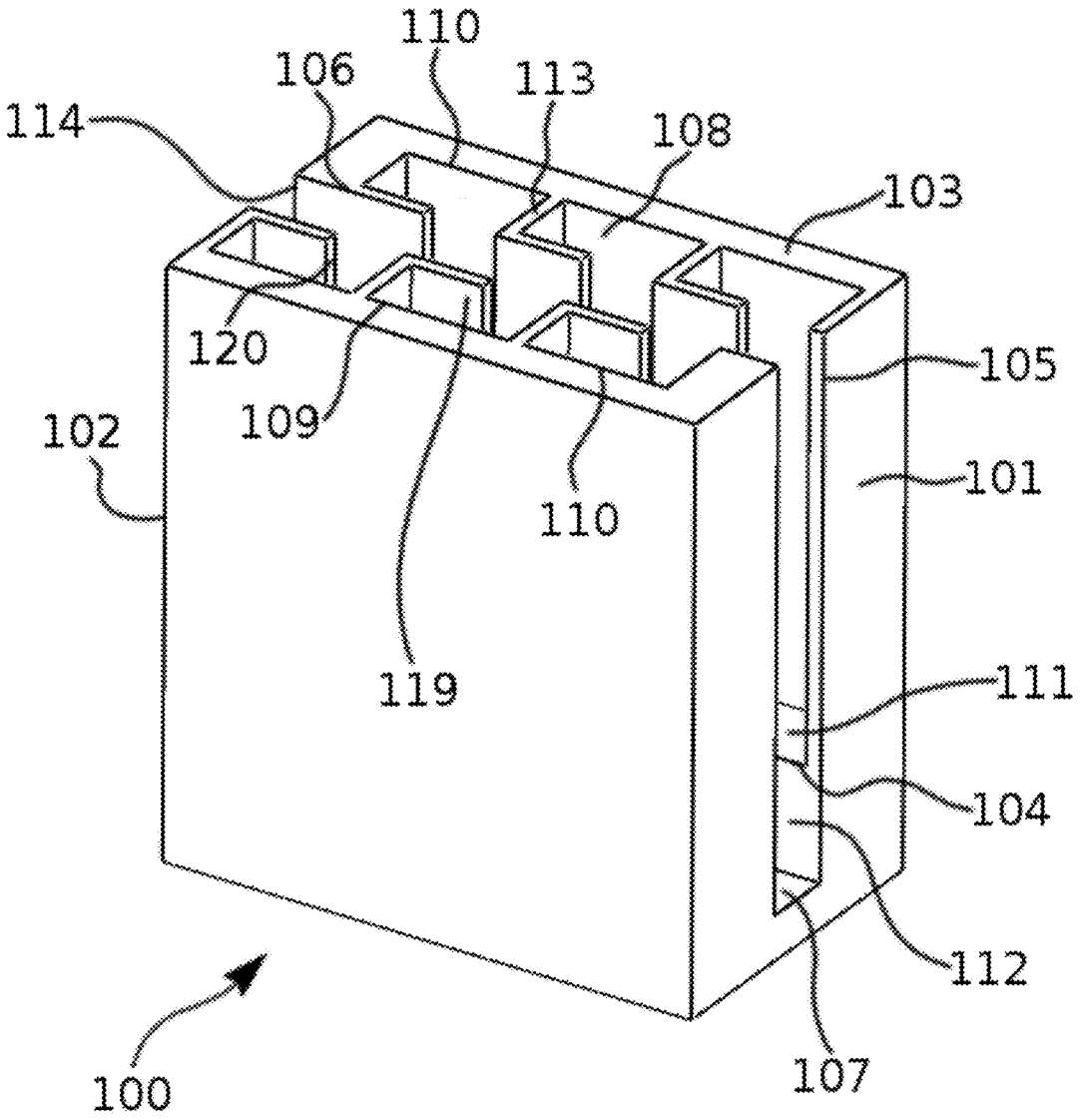
FIG. 1A is an angle side view of the preferred embodiment elongated rectangular box.
Figure 1B:
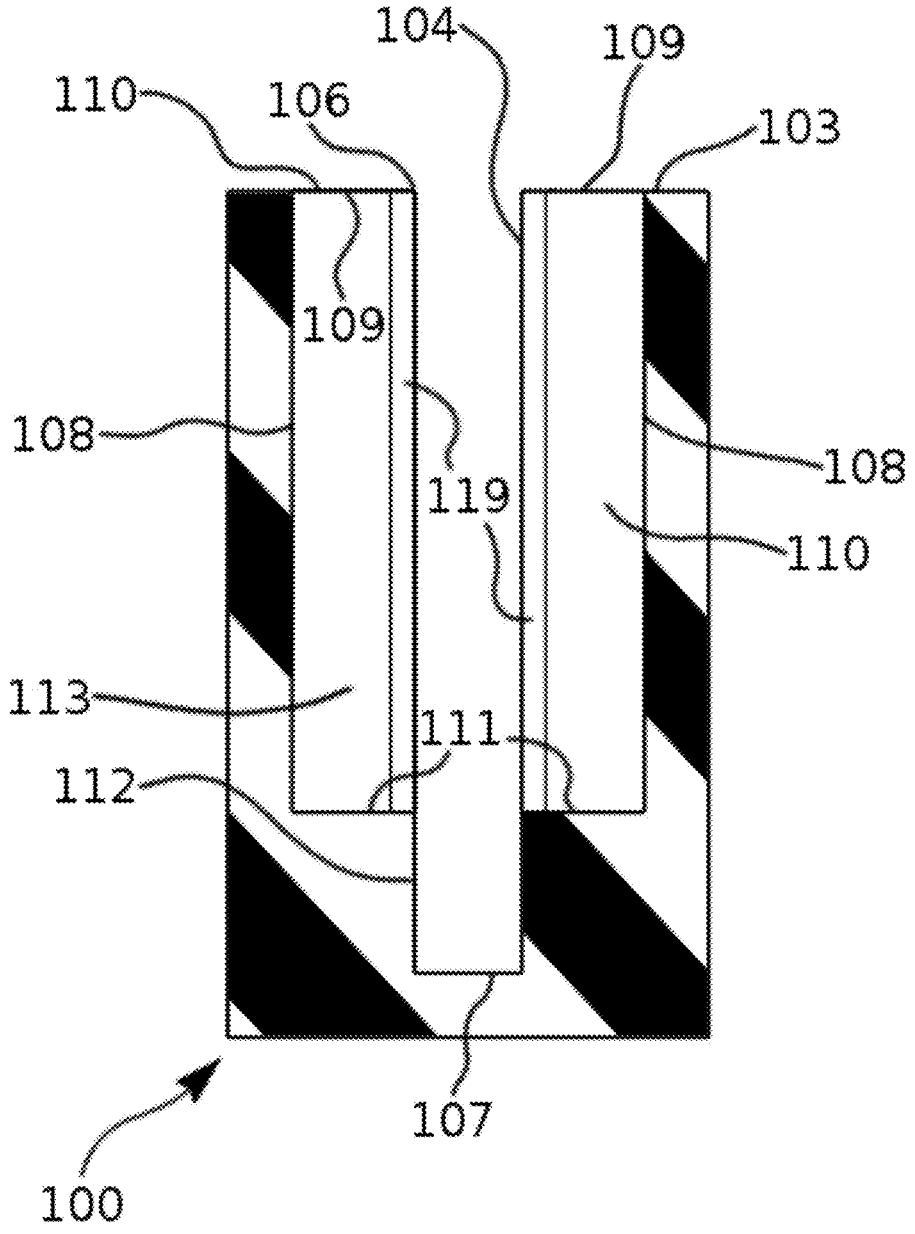
FIG. 1B is a front cross-section view of the elongated rectangular box.
Figure 1C:
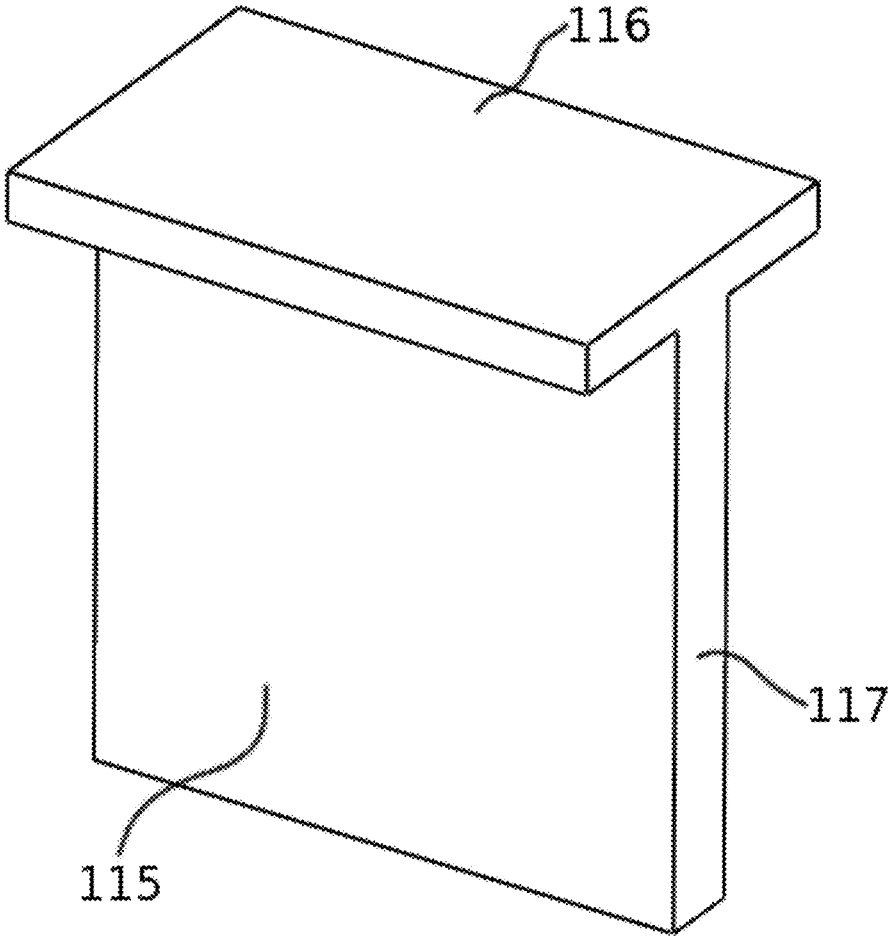
FIG. 1C is an angled side view of the preferred embodiment cartridge urging rod.
Figure 1D:
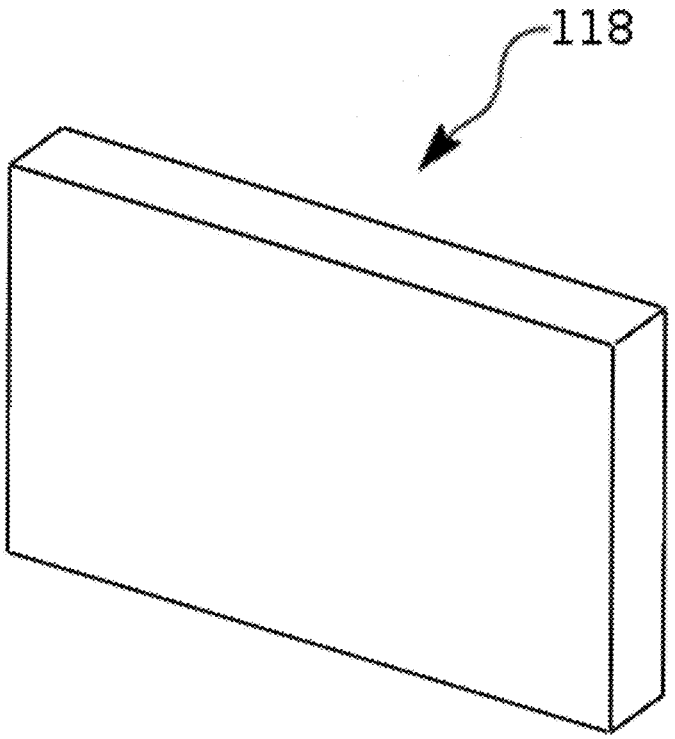
FIG. 1D is an angled side view of the preferred embodiment channel obstruction bar.
Figure 1E:
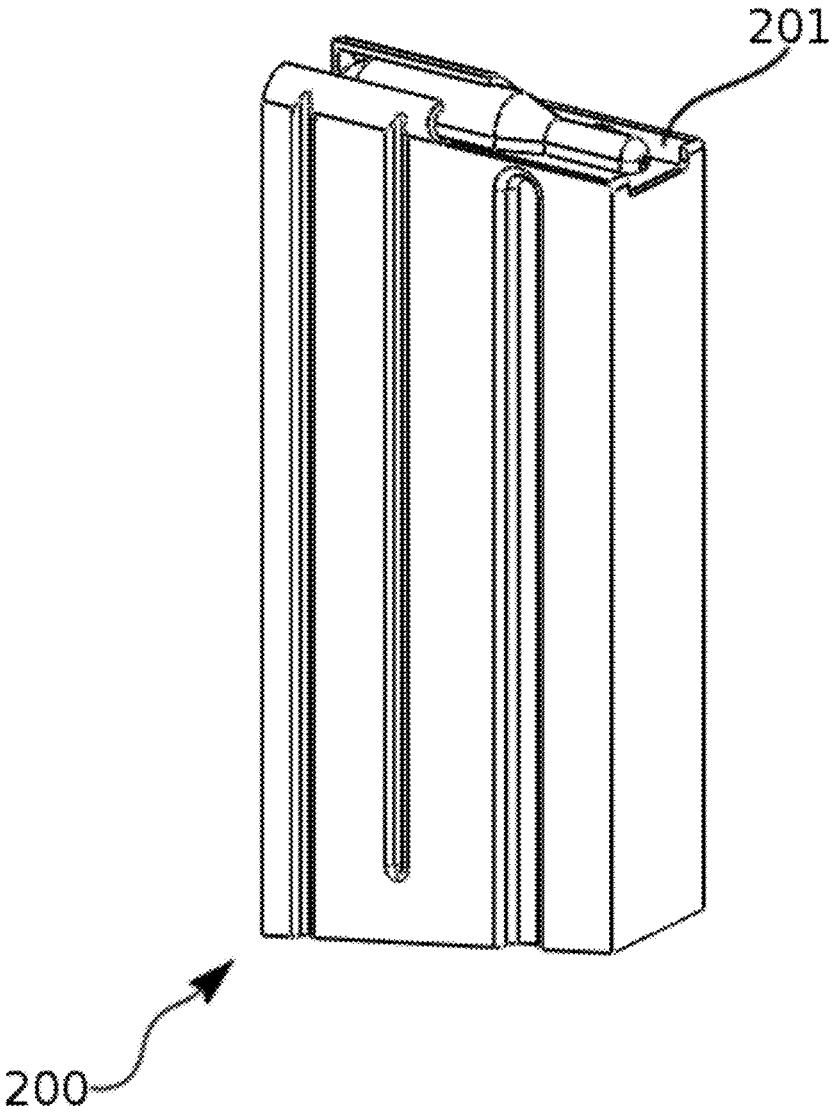
FIG. 1E is an angled side view of a firearms magazine.
Figure 1F:
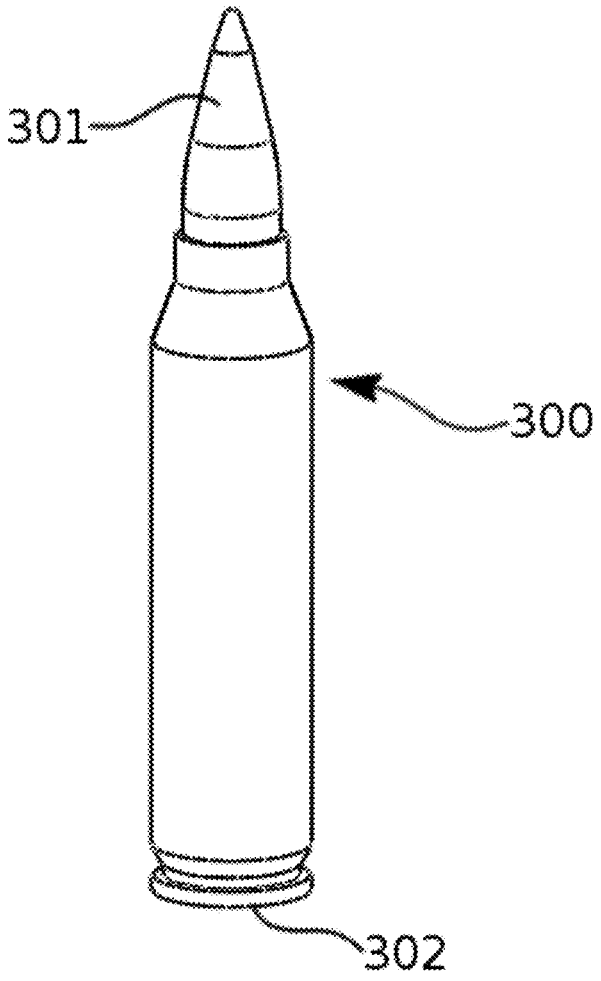
FIG. 1F is a frontal view of an ammunition cartridge.

In reference to FIGS. 1A, 1B, 1C, 1D, 1E, and 1F, an apparatus for storing and loading multiple rows of ammunition cartridges, in its preferred embodiment, comprises an elongated rectangular box 100. The rectangular box 100 comprises a proximal long end 101 and a distal long end 102 on opposite long ends of the rectangular box 100. The rectangular box further comprises an adjacent side 103, which occupies a facet of the rectangular box 100 that lies between the proximal long end 101 and distal long end 102. The rectangular box 100 further comprises a rectangular linear channel 104 that runs within the rectangular box 100, starting at the proximal long end 101 and terminating at the distal long end 102. The linear channel 104 is configured to receive and host ammunition cartridges 300. In one embodiment, the linear channel 104 hosts cartridges 300 in a single file configuration.

The proximal long end 101 defines a cartridge dispensing opening 105 that opens into the linear channel 104 and is configured to engage with a feed opening 201 of a firearms magazine 200. When engaged with the feed opening 201 of a firearms magazine 200, the dispensing opening 105 facilitates the passage of ammunition cartridges 300, hosted within the linear channel 104, from the linear channel 104 into the feed opening 201.

The adjacent side 103 of the rectangular box 100 defines a cartridge entry opening 106 that opens into the linear channel 104. The linear channel 104 defines a channel floor 107 that occupies a wall of the linear channel 104 that lies farthest from the cartridge entry opening 106.

In one embodiment, the linear channel 104 is shaped in such a manner that cartridges 300 received into the linear channel 104 are arranged into a single file whose length is parallel with that of the linear channel 104. In one embodiment, cartridges 300 received and hosted within the linear channel 104 are oriented in such a manner that their bullet tips 301 point toward the cartridge entry opening 106 from within the linear channel 104 while their base primer sides 302 are tangent with the channel floor 107.

The adjacent side 103 further defines multiple cartridge slots 108 that are individually recessed into the rectangular box 100 through the adjacent side 103. Each cartridge slot 108 comprises a topside opening 109 that leads into each cartridge slot 108 from the adjacent side 103. Each cartridge slot 108 is configured to host ammunition cartridges 300 and each topside opening 109 is configured to facilitate the positioning of cartridges 300 into its respective cartridge slot 108. In one embodiment, cartridge slots 108 are recessed into the rectangular box 100 at a depth equal to the height of an ammunition cartridge 300. Each cartridge slot 108 is convergent with the linear channel 104 and configured to displace cartridges 300 into the linear channel 104. In one embodiment, each cartridge slot 108 is sized to host one cartridge 300. In one embodiment, each cartridge slot 108 is sized to host two cartridges 300.

The cartridge slots 108 define slot floors 111, which are portions of the cartridge slots 108 that are furthest recessed into the rectangular box 100. In one embodiment, the cartridge slots 108 host cartridges 300 with the base primer sides 302 of cartridges 300 tangent with the slot floors 111. In one embodiment, the cartridge slots 108 host cartridges 300 with the bullet tips 301 of cartridges 300 tangent with the slot floors 111. The linear channel 104 defines a non-convergent height of space 112 within the linear channel 104 that lays between the slot floors 111 and the channel floor 107 and is non-convergent with the cartridge slots 108. This non-convergent height of space 112 is sized to maintain cartridges 300 positioned within the linear channel 104 in a single file configuration.

Each cartridge slot 108 extends a partition wall 113 that separates each cartridge slot 108 from an adjacent cartridge slot 108. In one embodiment, each cartridge slot 108 extends a partition wall 113 from a portion of the cartridge slot 108 that lies of farthest distance away from the dispensing opening 105. In one embodiment, the length of each partition wall 113 runs perpendicular to the length of the linear channel 104. In one embodiment, the cartridge slots 108 are arranged in two independent single file rows 110 whose lengths run parallel with that of the linear channel 104. In this same embodiment, these two independent rows 110 of cartridge slots 108 are tangent with the linear channel 104 on two opposing sides of the linear channel 104. Also in this same embodiment, the partition walls 113 on one row 110 of cartridge slots 108 are offset from linear alignment with the partition walls 113 of the opposing row 110 of cartridge slots 108.

Each cartridge slot 108 comprises an obstruction wall 119, whose length runs parallel with that of linear channel 104. Each obstruction wall 119 is tangent with the linear channel 104 and configured to obstruct cartridges 300 displaced from an opposing row 110 of cartridge slots 108 from entering the cartridge slot 108 that comprises it. In one embodiment, each obstruction wall 119 is perpendicularly extended from a partition wall 113 and runs in the direction of the dispensing opening 105 until within a gap of distance from the partition wall 113 of an adjacent cartridge slot 108. In one embodiment, this gap of distance is equal to the width of one ammunition cartridge 300. The gaps of distance between each obstruction wall 119 and adjacent cartridge slot partition wall 113 each define a cartridge slot side opening 120 that is configured to facilitate the passage of cartridges 300 from each cartridge slot 108 into the linear channel 104.

The distal long end 102 of the rectangular box 100 defines a rod entry opening 114 that opens into the linear channel 104 and is configured to facilitate the entry of a cartridge urging rod 115 into the linear channel 104.

The apparatus for storing and loading multiple rows of ammunition, in its preferred embodiment, comprises an urging rod 115 that is shaped as an elongated rectangular block with two short sides and four long sides. The urging rod 115 is configured to slideably engage within the linear channel 104, through the rod entry opening 114, with two opposing long sides of the urging rod 115 slideably engaged with the non-convergent height of space 112 and one long side slideably engaged with the channel floor 107. The urging rod 115 comprises a planar shaped flat cover 116 that extends from the one long side of the urging rod 115 that does not slideably engage with the non-convergent height of space 112 or the channel floor 107 when the urging rod 115 is engaged within the linear channel 104. The flat cover 116 extends from the urging rod 115 in such a manner as to form a T shape with the urging rod 115. The flat cover 116 runs the length of the urging rod 115 and is sized to encapsulate the rectangular box adjacent side 103. The urging rod 115 further comprises a pressing surface 117 on a short side of the urging rod 115 that faces foremost towards the dispensing opening 105 when the urging rod 115 is slideably engaged within the linear channel 104 through the rod entry opening 114. The pressing surface 117 is configured to urge ammunition cartridges 300 and objects hosted within the linear channel 104 out from the linear channel 104 through the dispensing opening 105. The length of the urging rod 115 is sized so as to cause the urging rod 115 to fully encapsulate the linear channel 104 when the urging rod 115 is slideably engaged within the linear channel 104 and the pressing surface 117 is tangent with the dispensing opening 105. When the urging rod 115 is engaged with linear channel 104 in such a manner that it fully encapsulates the linear channel 104, the urging rod 115 obstructs objects from entering into the linear channel 104 via the dispensing opening 105, cartridge entry opening 106, the slot side openings 120 and the rod entry opening 114. Simultaneously, when the urging rod 115 is engaged to fully encapsulate the linear channel 104, the flat cover 116 encapsulates the adjacent side 103 and obstructs the passage of cartridges 300 and objects into and out from the cartridge slots 108 via the topside openings 109.

The apparatus for storing and loading multiple rows of ammunition, in its preferred embodiment, comprises a channel obstruction block 118. The obstruction block 118 is shaped as a rectangular block and is sized to slideably engage within the linear channel 104, via the dispensing opening 105, cartridge entry opening 106 or rod entry opening 114, and obstruct the slot side openings 120, preventing cartridges 300 hosted within the cartridge slots 108 from moving into the linear channel 104 via the slot side openings 120. In one embodiment, the obstruction block 118 is sized to fully encapsulate the linear channel 104.

Figure 2A:
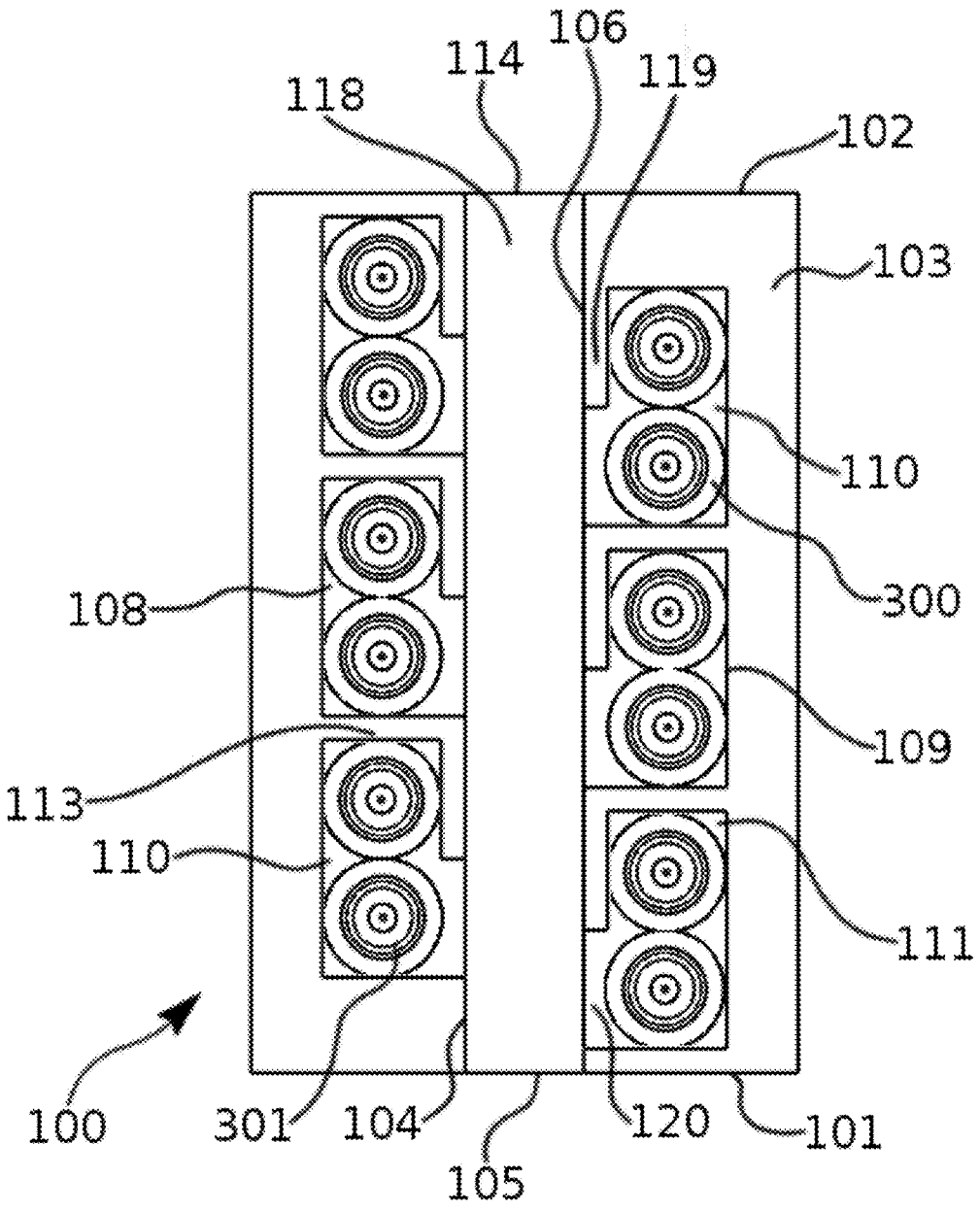
FIG. 2A is a top down view of the preferred embodiment elongated rectangular box, configured with ammunition cartridges, slideably engaged with the channel obstruction bar.
Figure 2B:
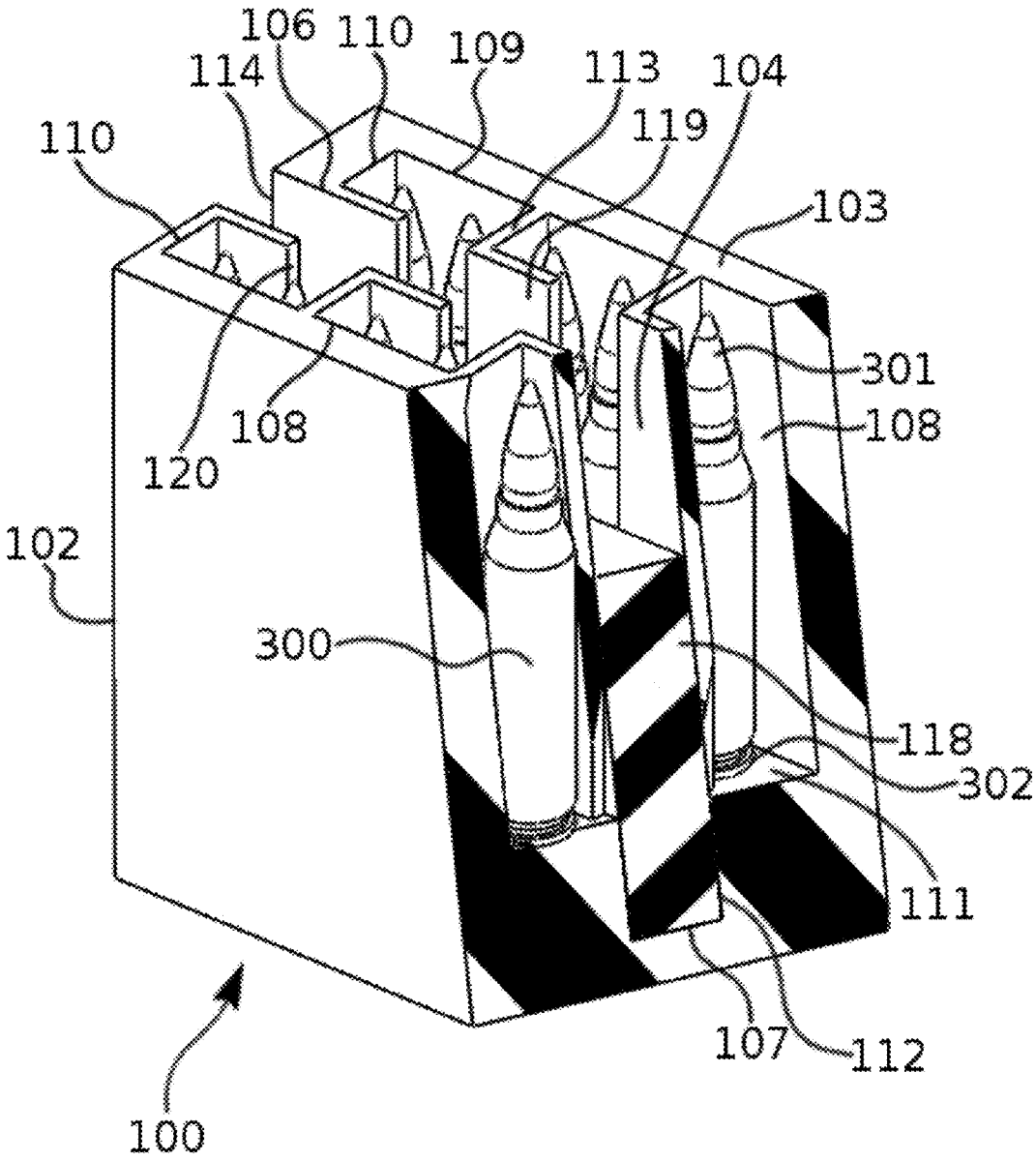
FIG. 2B is an angled side view cross section of the preferred embodiment elongated rectangular box, configured with ammunition cartridges, slideably engaged with the channel obstruction bar.

In reference to FIGS. 2A and 2B, the apparatus for storing and loading multiple rows of ammunition cartridges is configured to receive ammunition cartridges 300 into the cartridge slots 108 with the engagement of the obstruction block 118 into the linear channel 104 via the dispensing opening 105, cartridge entry opening 106 or rod entry opening 114. In one embodiment, the obstruction block 118 is engaged within the linear channel 104 in such a manner that the length of the obstruction block 118 fully encompasses that of the linear channel 104.

Ammunition cartridges 300 are positioned into the cartridge slots 108 through the adjacent side topside openings 109. In one embodiment, cartridges 300 are inserted through the topside openings 109 with the base primer sides 302 of cartridges 300 facing foremost towards the slot floors 111. In one embodiment, cartridges 300 are inserted through the topside openings 109 with the bullet tips 301 of cartridges 300 facing foremost towards the slot floors 111. The obstruction block 118 maintains the cartridges 300 positioned into the cartridge slots 108 from moving into the linear channel 104 via the slot side openings 120.

Figure 3:
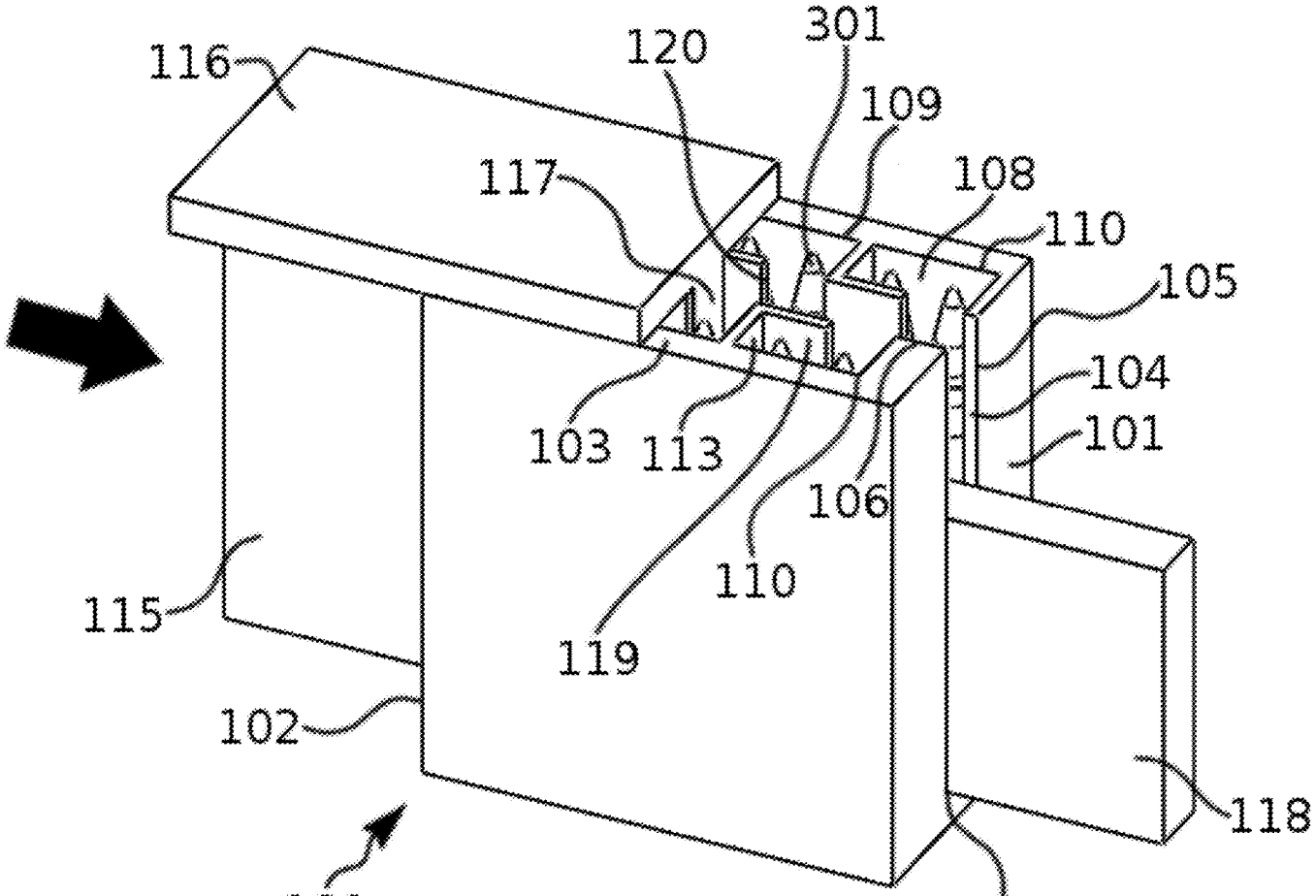
FIG. 3 is an angled side view of the preferred embodiment cartridge urging rod, slideably engaged within the elongated rectangular box, urging out the channel obstruction bar from the elongated rectangular box.

In reference to FIG. 3, the apparatus for storing and loading multiple rows of ammunition cartridges is configured to sterily store ammunition cartridges 300 with the engagement of the urging rod 115 into the linear channel 104 via the rod entry opening 114. The urging rod 115 is engaged within the linear channel 104 in such a manner that the pressing surface 117 is placed foremost through the rod entry opening 114 while the flat cover 116 slideably engages with the rectangular box adjacent side 103. Within the linear channel 104, the pressing surface 117, and thus the urging rod 115, is urged through the rod entry opening 114 towards the dispensing opening 105, causing the pressing surface 117 to urge the obstruction block 118 out from the linear channel 104 through the dispensing opening 105. While moving toward the dispensing opening 105, the urging rod 115 and flat cover 116 come into tangency with successive slot side openings 120 and topside openings 109, respectively. These successive slot side openings 120 and topside openings 109 are subsequently encapsulated by the urging rod 115 and flat cover 116, respectively, preventing cartridges 300 hosted within the successively encapsulated cartridge slots 108 from moving out from their respective cartridge slots 108. The pressing surface 117 is eventually brought into tangency with the dispensing opening 105, which causes the pressing surface 117 to fully displace the obstruction block 118 from the linear channel 104 through the dispensing opening 105. Simultaneously, the flat cover 116 is shifted to fully encapsulate the adjacent side 103, and thus all of the topside openings 109.

Figure 4:
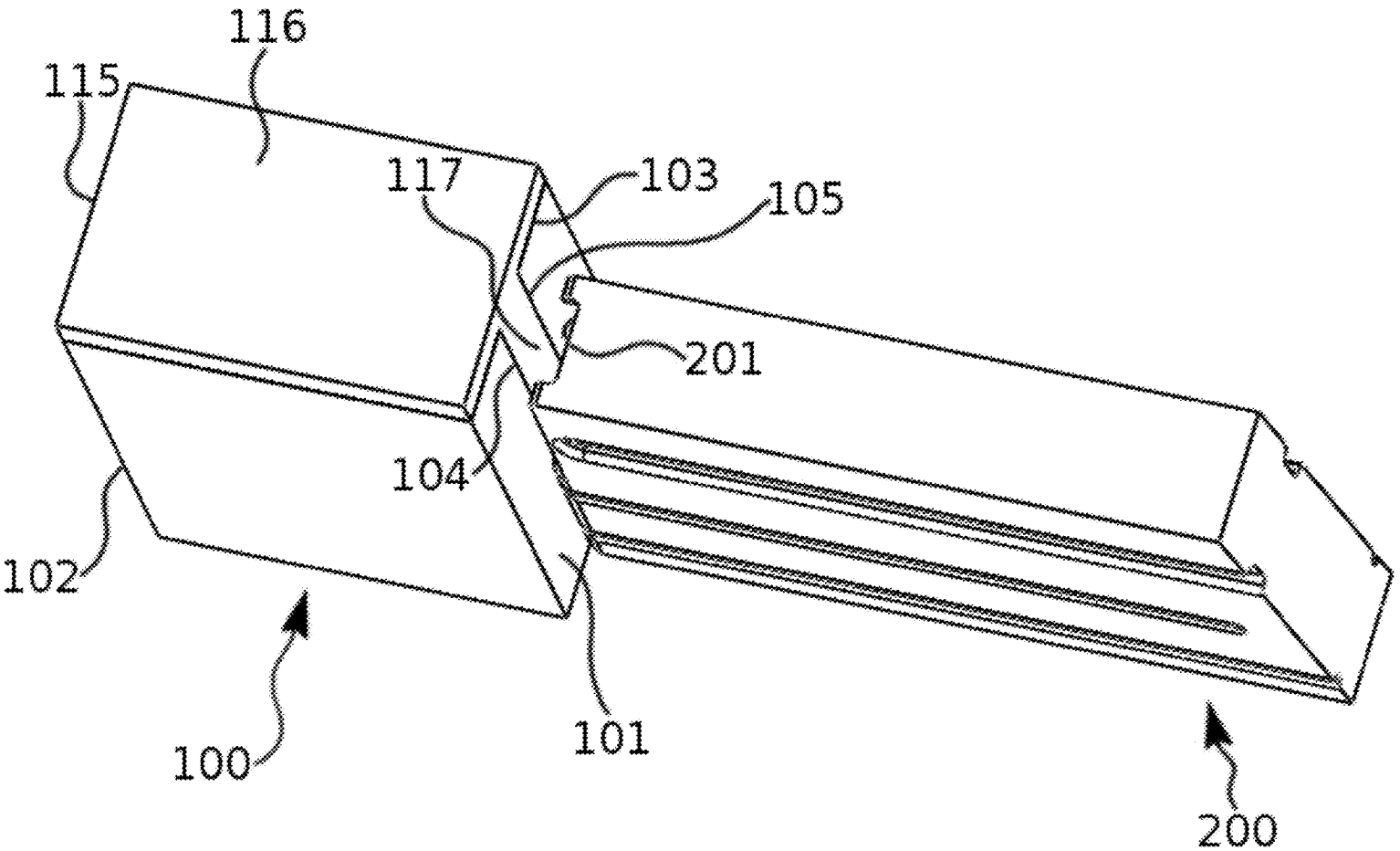
FIG. 4 is an angled side view of the preferred embodiment elongated rectangular box, engaged with the cartridge urging rod, interfaced with a firearms magazine and canted.

In reference to FIG. 4, the apparatus for storing and loading multiple rows of ammunition cartridges is interfaced with a firearms magazine 200 via the engagement of the rectangular box dispensing opening 105 to a feed opening 201 of the firearms magazine 200. A magazine feed opening 201 is engaged to the dispensing opening 105 in such a manner that the magazine 200 is oriented, relative to the dispensing opening 105, to receive cartridges 300 from the rectangular box linear channel 104, through the dispensing opening 105, in the same angular orientation by which the magazine 200 properly feeds ammunition cartridges 300 into a firearm.

The apparatus for storing and loading multiple rows of ammunition cartridges is configured to displace successive rows 110 of cartridge slots 108, hosting cartridges 300, into the linear channel 104 with the canting of the apparatus and interfaced magazine 200 to such an orientation as to cause a row 110, containing cartridges 300 that are subject to displacement, to elevate over an opposing row 110 of cartridge slots 108. The apparatus and interfaced magazine 200 are also oriented in such a manner as to cause the rod entry opening 114 to elevate over the dispensing opening 105.

Figure 5A:
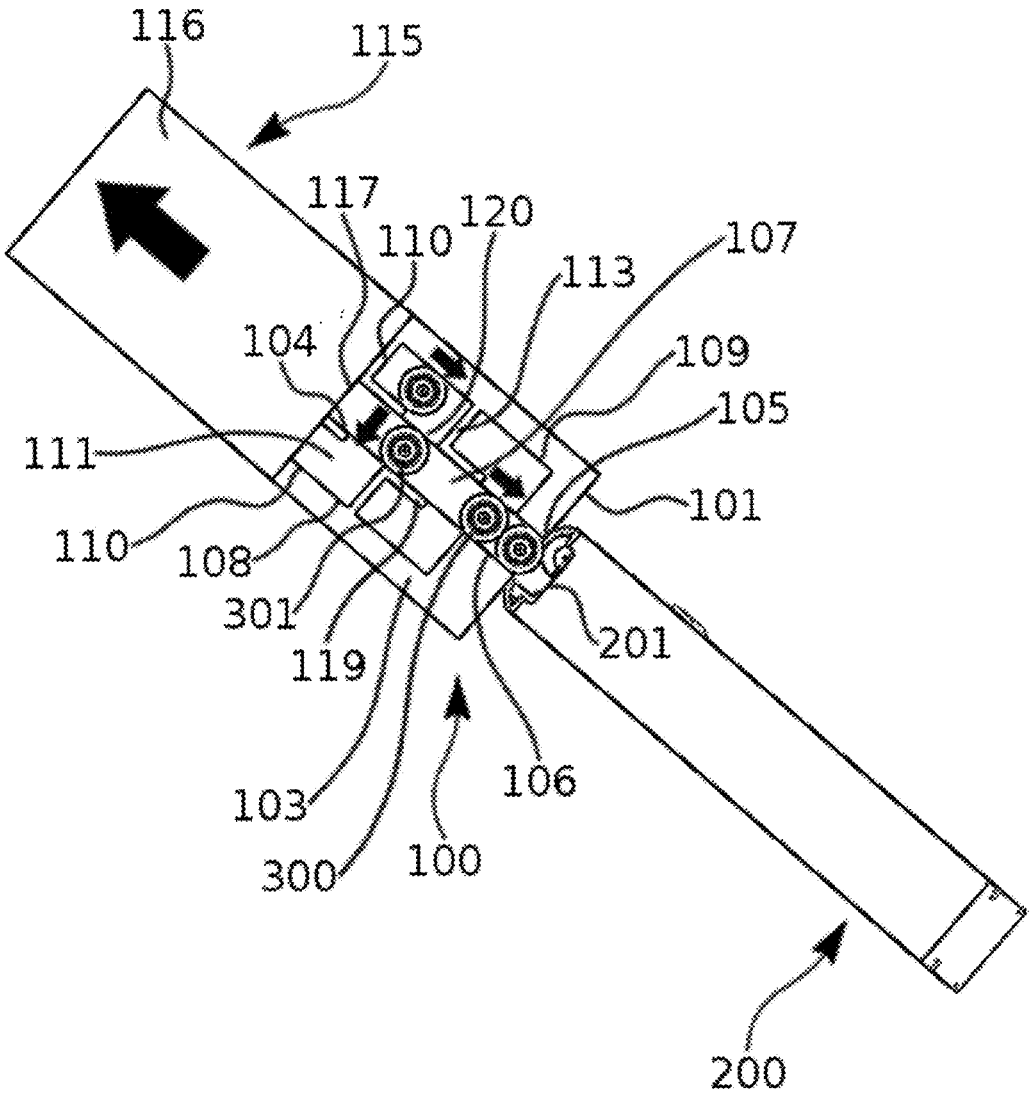
FIG. 5A is a side view of the preferred embodiment cartridge urging rod partially retracted from the canted elongated rectangular box.
Figure 5B:
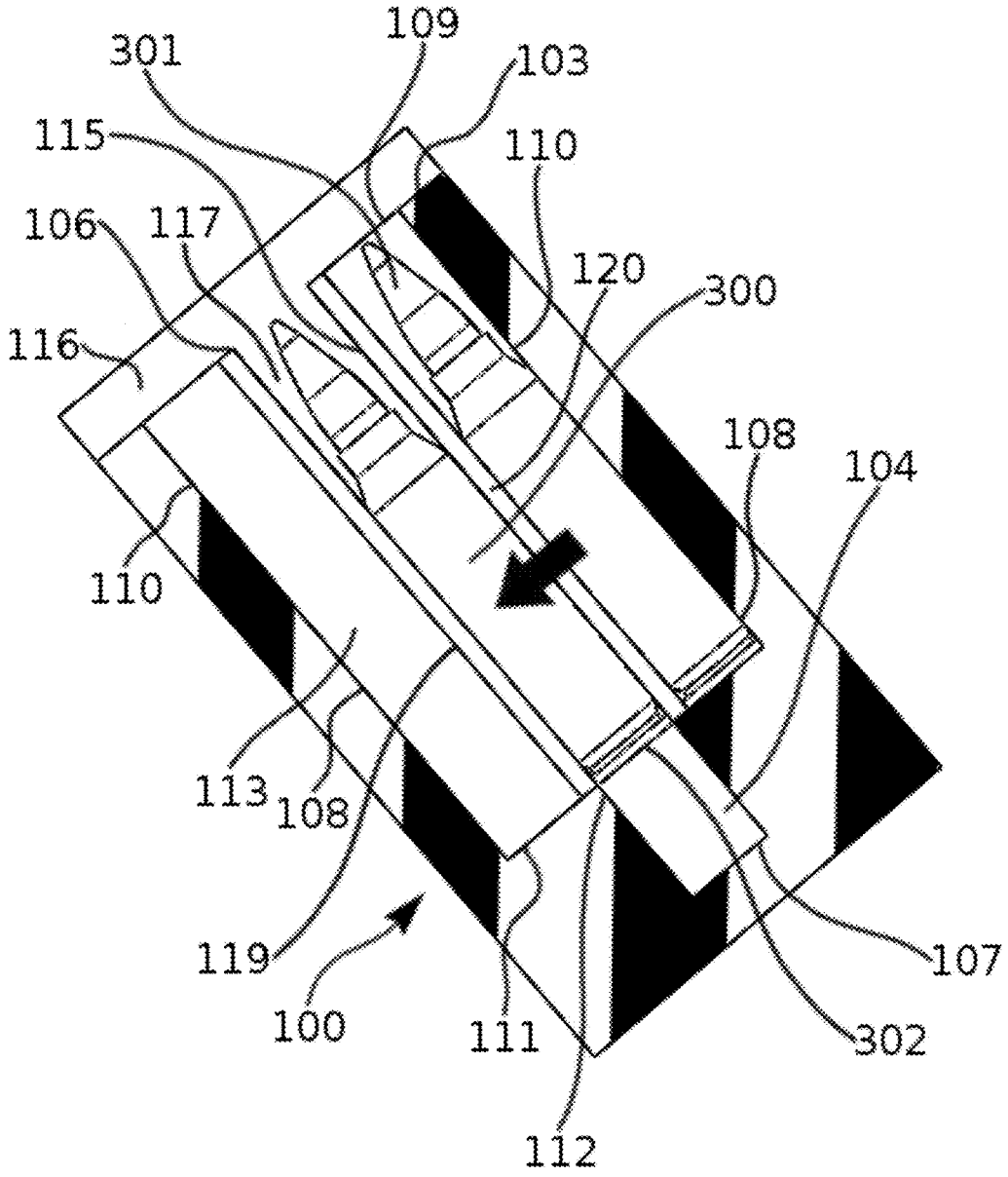
FIG. 5B is a front cross section view of an ammunition cartridge, displaced from a cartridge slot towards an opposing row of cartridge slot, obstructed from movement into the opposing row by an obstruction wall.
Figure 5C:
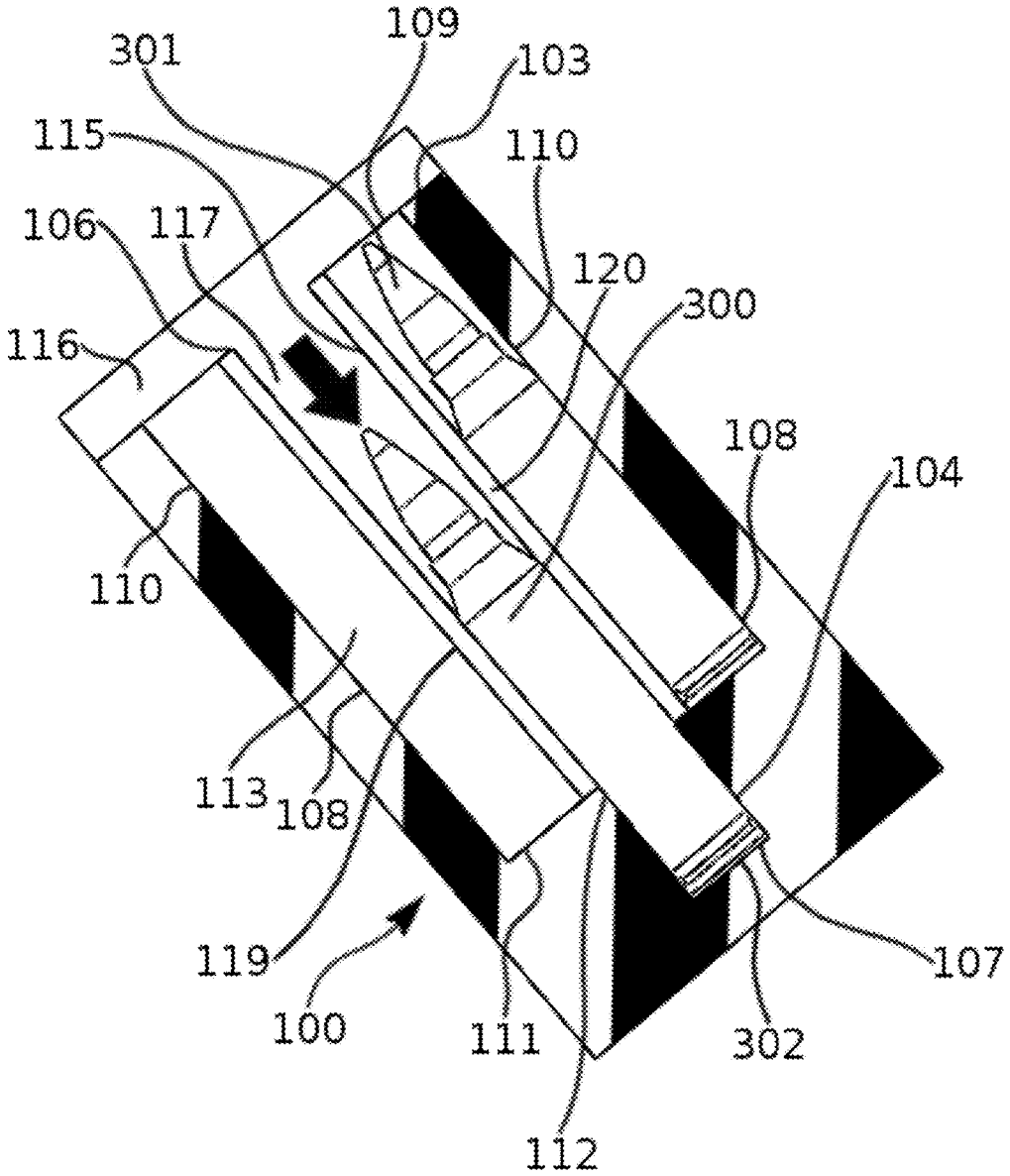
FIG. 5C is a front cross section view of an ammunition cartridge, obstructed from movement into an opposing row, vectored towards the channel floor.

In reference to FIGS. 5A, 5B and 5C, the urging rod 115 is retracted from the linear channel 104 through the rod entry opening 114, clearing a path for successive cartridges 300, hosted within the elevated row 110 of cartridge slots 108, to shift out from their respective cartridge slots 108 into the linear channel 104, via their corresponding slot side openings 120. In one embodiment, cartridges 300 are shifted through their corresponding slot side openings 120 via the force of gravity. In one embodiment, each cartridge slot 108 hosts multiple cartridges 300 and thus each cartridge 300 hosted within each cartridge slot 108 first shifts toward its respective slot side opening 120, by means of gravity, prior to passing through it. Each cartridge 300, upon passing through its respective slot side opening 120, exits from its cartridge slot 108 and moves toward an opposing row 110 of cartridge slots 108 until obstructed from further directional movement by an obstruction wall 119 of the opposing row 110 or a cartridge 300 hosted within the opposing row 110. Simultaneous to the point of when each displaced cartridge 300 is obstructed by an obstruction wall 119 or a cartridge 300, the width of each obstructed cartridge 300 lines up with the width of the linear channel 104, allowing each obstructed cartridge 300 to enter the non-convergent height of space 112 within the linear channel 104 by means of gravity. Each cartridge 300 proceeds down the non-convergent height of space 112 until obstructed from further movement by the channel floor 107. Simultaneously, each cartridge 300 also moves towards the dispensing opening 105, aided by gravity, until coming into tangency with the coupled magazine feed opening 201 or a cartridge 300 that is stacked in succession leading into the feed opening 201. In one embodiment, cartridges 300 displaced into the linear channel 104 are filed into a single file row, whose length runs parallel with that of the linear channel 104, by the non-convergent height of space 112.

Figure 6:
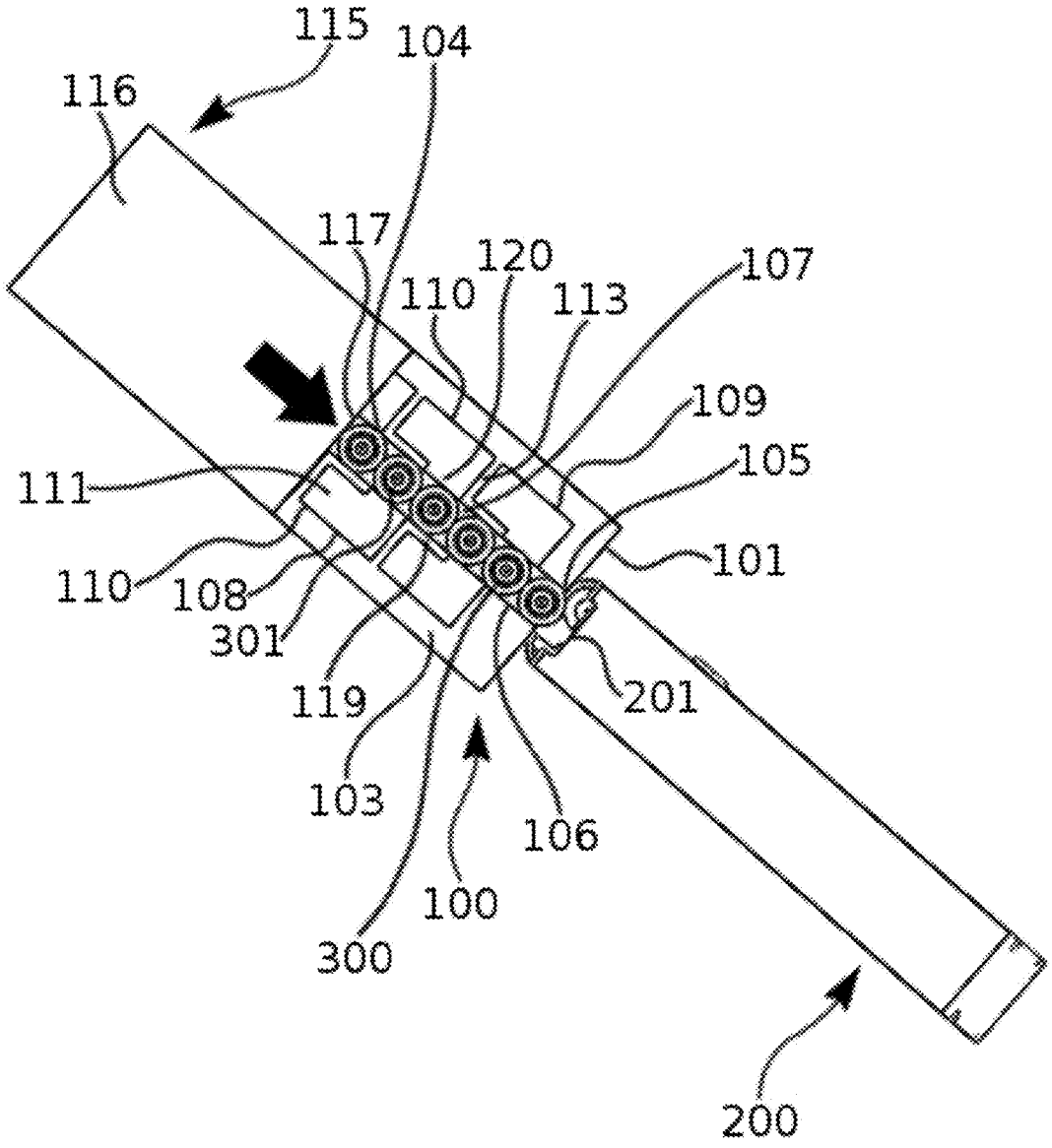
FIG. 6 is a side view of the preferred embodiment cartridge urging rod urging cartridges within the linear channel into the interfaced firearms magazine.

In reference to FIG. 6, the apparatus for storing and loading multiple rows of ammunition cartridges urges successive row 110 of cartridges 300, displaced into the linear channel 104, into an interfaced firearms magazine 200 with the urging of the pressing surface 117, and thus the urging rod 115, towards the dispensing opening 105. The pressing surface 117, moving towards the dispensing opening 105, comes into tangency with an ammunition cartridge 300 that is of closest proximity to it within the linear channel 104. Upon coming into tangency with a cartridge 300, the urging rod 115 urges said cartridge 300 towards the dispensing opening 105, subsequently causing successive cartridges 300 within the linear channel 104 to urge adjacent cartridges 300 towards the dispensing opening 105. Consequently, the action of urging the rod 115 towards tangency with the dispensing opening 105 causes each cartridge 300 within the linear channel 104 to be displaced from the linear channel 104, through the dispensing opening 105, into the feed opening 201 of the interfaced firearms magazine 200.

The invention claimed is:

1. An apparatus for storing and loading ammunition cartridges into a firearms magazine, comprising:

an elongated rectangular box, comprising a proximal end and a distal end on opposite long ends of the rectangular box;

an adjacent side, located on a side of the rectangular box that lies between the proximal end and the distal end;

a linear channel, running within the rectangular box from the proximal end to the distal end, configured to receive and host ammunition cartridges;

a cartridge dispensing opening, located on the proximal end, open to the linear channel in order to facilitate the passage of ammunition cartridges and objects into and out from the linear channel, and configured to couple with a feed opening of a firearms magazine;

a rod entry opening, located on the distal end, and open to the linear channel in order to facilitate the passage of ammunition cartridges and objects into and out from the linear channel;

a cartridge entry opening, located on the adjacent side, open to the linear channel in order to facilitate the passage of ammunition cartridges and objects into and out from the linear channel;

a linear channel floor, located on a wall of the linear channel opposite the adjacent side;

multiple ammunition cartridge slots, recessed into the rectangular box through the adjacent side, and configured to converge with the linear channel and host ammunition cartridges;

a cartridge urging rod, configured to selectively slideably engage within the linear channel and urge ammunition cartridges and objects hosted within the linear channel out from the linear channel;

a flat cover, coupled to the cartridge urging rod, and sized to cover the adjacent side when the cartridge urging rod is positioned within the linear channel; and a channel obstruction block, configured to selectively engage within the linear channel and obstruct cartridges hosted within the cartridge slots from passing into the linear channel.

2. The apparatus of claim 1, wherein each ammunition cartridge slot of the multiple ammunition cartridge slots is configured to host a single ammunition cartridge.

3. The apparatus of claim 1, wherein each ammunition cartridge slot of the multiple ammunition cartridge slots is configured to host multiple ammunition cartridges.

4. The apparatus of claim 1, wherein the multiple ammunition cartridge slots are arranged in multiple independent rows that run parallel to and convergent with the linear channel.

5. The apparatus of claim 4, wherein the multiple cartridge slots are arranged in two independent rows, each of which lie adjacent to the linear channel on two opposing sides of the linear channel.

6. The apparatus of claim 4, wherein each ammunition cartridge slot of the multiple ammunition cartridge slots comprises a partition wall that segregates a respective ammunition cartridge slot from an adjacent cartridge slot.

7. The apparatus of claim 6, wherein the partition walls of a first row of ammunition cartridge slots are offset from linear alignment with the partition walls of a second row of ammunition cartridge slots.

8. The apparatus of claim 6, wherein each ammunition cartridge slot of the multiple ammunition cartridge slots comprises an obstruction wall that is configured to obstruct ammunition cartridges, displaced from an adjacent row of ammunition cartridge slots, from entering into the respective ammunition cartridge slot.

9. The apparatus of claim 8, wherein each said obstruction wall is tangent with a respective partition wall.

10. The apparatus of claim 1, wherein openings in the adjacent side leading into each ammunition cartridge slot of the multiple ammunition cartridge slots are configured to facilitate the passage of ammunition cartridges into the multiple ammunition cartridge slots.

11. The apparatus of claim 1, wherein the cartridge urging rod is configured to selectively engage within the linear channel in such a manner as to encapsulate the linear channel and obstruct ammunition cartridges hosted within the multiple ammunition cartridge slots from passing into the linear channel.

12. The apparatus of claim 11, wherein the flat cover is coupled to the cartridge urging rod in such a manner that when the cartridge urging rod is slideably engaged within the linear channel, the flat cover is slideably engaged with the adjacent side.

13. The apparatus of claim 1, wherein the linear channel is configured to host ammunition cartridges in a single row configuration.

14. The apparatus of claim 13, wherein the multiple ammunition cartridge slots are recessed into the rectangular box to such a depth as to leave a height of space within the linear channel, spanning from a bottom of each ammunition cartridge slot of the multiple ammunition cartridge slots to the linear channel floor.

15. The apparatus of claim 14, wherein the height of space is sized to encapsulate a sufficient portion of ammunition cartridges, hosted within the linear channel, to maintain the ammunition cartridges in a single file configuration.

16. The apparatus of claim 1, wherein the multiple ammunition cartridge slots are recessed into the rectangular box to a depth equal to a height of ammunition cartridges to be hosted in the multiple ammunition cartridge slots.

17. The apparatus of claim 1, wherein the linear channel is configured to host ammunition cartridges with base primer sides of the ammunition cartridges against the linear channel floor.

18. The apparatus of claim 1, wherein the linear channel is configured to host ammunition cartridges with bullet tips of the ammunition cartridges against the linear channel floor.

19. A method for storing ammunition cartridges within an apparatus for storing and loading ammunition, comprising:

providing the apparatus of claim 1;

slideably engaging the channel obstruction block into the linear channel through the cartridge dispensing opening, the cartridge entry opening or the rod entry opening;

following the slideably engaging the channel obstruction block, positioning ammunition cartridges into the cartridge slots through openings on the adjacent side leading into the cartridge slots;

following the positioning ammunition cartridges, slideably engaging the cartridge urging rod within the linear channel through the rod entry opening while slideably engaging the flat cover with the adjacent side;

following the slideably engaging the cartridge urging rod within the linear channel, urging the cartridge urging rod towards the cartridge dispensing opening and thereby displacing the obstruction block from the linear channel through the cartridge dispensing opening; and simultaneous to the urging the cartridge urging rod towards the cartridge dispensing opening, obstructing openings leading from the cartridge slots into the linear channel with the cartridge urging rod while covering openings on the adjacent side leading into the cartridge slots with the flat cover.

20. A method for loading ammunition cartridges into a firearms magazine using an apparatus for storing and loading ammunition, comprising:

performing the method of claim 19;

following the performing:

coupling a feed opening of an ammunition magazine with the dispensing opening of the apparatus;

canting the elongated rectangular box and the coupled ammunition magazine in such a manner as to cause gravity to influence ammunition cartridges in a first row of ammunition cartridge slots of the multiple ammunition cartridge slots toward a second row of ammunition cartridge slots of the multiple ammunition cartridge slots that is segregated from the first row by the linear channel;

simultaneous to the canting the elongated rectangular box and the coupled ammunition magazine, likewise canting the elongated rectangular box and the coupled ammunition magazine in such a manner as to elevate the rod entry opening over the cartridge dispensing opening;

following the cantings of the elongated rectangular box and the coupled ammunition magazine, retracting the cartridge urging rod out from the linear channel through the rod entry opening and displacing successive ammunition cartridges in the first row of ammunition cartridge slots toward the second row of ammunition cartridge slots;

following the displacing successive ammunition cartridges in the first row of ammunition cartridge slots, obstructing directional movement of ammunition cartridges displaced from the first row with obstruction walls or ammunition cartridges of the second row;

following the obstructing directional movement of ammunition cartridges displaced from the first row, vectoring obstructed ammunition cartridges into the linear channel toward the channel floor, by force of gravity;

simultaneous to the vectoring obstructed ammunition cartridges into the linear channel and toward the channel floor, likewise vectoring ammunition cartridges towards the cartridge dispensing opening, by means of gravity; and following the vectoring ammunition cartridges towards the cartridge dispensing opening, urging the vectored ammunition cartridges from the linear channel into the feed opening of the coupled ammunition magazine via urging the cartridge urging rod through the linear channel and toward the cartridge dispensing opening.

21. An apparatus for storing and loading ammunition cartridges into a firearms magazine, the apparatus comprising:

an elongated box having a proximal end, a distal end opposite the proximal end, an adjacent side extending between the proximal end and the distal end, wherein the proximal end is configured to be coupled with a feed opening of a firearms magazine, wherein the elongated box defines a linear channel running longitudinally from the proximal end to the distal end, wherein the linear channel has a linear channel floor opposite the adjacent side, wherein the elongated box defines multiple ammunition cartridge slots configured to receive ammunition cartridges via the adjacent side, wherein the multiple ammunition cartridge slots are spaced longitudinally along at least one lateral side of the linear channel, wherein each ammunition cartridge slot of the multiple ammunition cartridge slots is configured to receive one or more ammunition cartridges and has a respective slot floor that is offset from the linear channel floor, and wherein the elongated box includes partition walls that separate adjacent ammunition cartridge slots of the multiple ammunition cartridge slots;

a cartridge urging rod configured to be inserted into and slide along the linear channel from the distal end to the proximal end, wherein the cartridge urging rod is configured to urge ammunition cartridges that have been displaced from the multiple ammunition cartridge slots into the linear channel from the linear channel out of the elongated box via the proximal end; and a cover coupled to the cartridge urging rod and configured to slide along the adjacent side and cover the multiple ammunition cartridge slots when the cartridge urging rod is inserted into and slid along the linear channel from the distal end to the proximal end.

22. The apparatus of claim 21, wherein the multiple ammunition cartridge slots comprise a first row of slots on a first lateral side of the linear channel and a second row of slots on a second lateral side of the linear channel opposite the first lateral side.

23. The apparatus of claim 22, wherein the partition walls of the first row are longitudinally offset from the partition walls of the second row.

24. An apparatus for storing and loading ammunition cartridges into a firearms magazine, the apparatus comprising:

an elongated box having a proximal end, a distal end opposite the proximal end, an adjacent side extending between the proximal end and the distal end, wherein the proximal end is configured to be coupled with a feed opening of a firearms magazine, wherein the elongated box defines a linear channel running longitudinally from the proximal end to the distal end, wherein the linear channel has a linear channel floor opposite the adjacent side, wherein the elongated box defines multiple ammunition cartridge slots configured to receive ammunition cartridges via the adjacent side, wherein the multiple ammunition cartridge slots are spaced longitudinally along at least one lateral side of the linear channel, wherein each ammunition cartridge slot of the multiple ammunition cartridge slots is configured to receive one or more ammunition cartridges and has a respective slot floor that is offset from the linear channel floor, and wherein the elongated box includes partition walls that separate adjacent ammunition cartridge slots of the multiple ammunition cartridge slots; and a cartridge urging rod configured to be inserted into and slide along the linear channel from the distal end to the proximal end, wherein the cartridge urging rod is configured to urge ammunition cartridges that have been displaced from the multiple ammunition cartridge slots into the linear channel from the linear channel out of the elongated box via the proximal end;

wherein the multiple ammunition cartridge slots comprise a first row of slots on a first lateral side of the linear channel and a second row of slots on a second lateral side of the linear channel opposite the first lateral side.

* * * * *